US007886490B2

(12) United States Patent
Maekawa et al.

(10) Patent No.: US 7,886,490 B2
(45) Date of Patent: Feb. 15, 2011

(54) STRAND

(75) Inventors: Tomoya Maekawa, Itami (JP); Toshihiko Niki, Itami (JP); Yoshihiko Touda, Itami (JP); Katsuhito Oshima, Itami (JP)

(73) Assignee: Sumitomo (SEI) Steel Wire Corp., Itami-shi (JP)

( * ) Notice: Subject to any disclaimer, the term of this patent is extended or adjusted under 35 U.S.C. 154(b) by 0 days.

(21) Appl. No.: 12/529,298

(22) PCT Filed: Jan. 28, 2008

(86) PCT No.: PCT/JP2008/000097

§ 371 (c)(1),
(2), (4) Date: Aug. 31, 2009

(87) PCT Pub. No.: WO2008/108053

PCT Pub. Date: Sep. 12, 2008

(65) Prior Publication Data

US 2010/0050546 A1 Mar. 4, 2010

(30) Foreign Application Priority Data

Mar. 2, 2007 (JP) ..... 2007-053481
Nov. 29, 2007 (JP) ..... 2007-309246

(51) Int. Cl.
*E04C 5/08* (2006.01)

(52) U.S. Cl. ..... 52/223.14; 52/223.4; 52/223.11; 52/223.8; 14/22

(58) Field of Classification Search ..... 52/223.1, 52/223.4, 223.6–223.14; 24/122.6, 136 R; 264/228; 14/18–22
See application file for complete search history.

(56) References Cited

U.S. PATENT DOCUMENTS

| | | | | |
|---|---|---|---|---|
| 2,763,464 | A * | 9/1956 | Leonhardt | 254/29 A |
| 2,867,884 | A * | 1/1959 | Brandt | 52/699 |
| 3,513,609 | A * | 5/1970 | Lang | 52/223.6 |
| 3,738,071 | A * | 6/1973 | Finsterwalder | 52/155 |
| 4,557,007 | A * | 12/1985 | Daiguji et al. | 14/22 |
| 5,389,765 | A * | 2/1995 | Baer | 219/635 |
| 5,469,677 | A * | 11/1995 | Luthi | 52/223.13 |
| 5,545,987 | A * | 8/1996 | Schutt et al. | 324/219 |
| 5,802,788 | A * | 9/1998 | Ozawa et al. | 52/223.13 |
| 2002/0108329 | A1 * | 8/2002 | Bournand et al. | 52/223.13 |

FOREIGN PATENT DOCUMENTS

| | | |
|---|---|---|
| JP | 5-44301 | 2/1993 |
| JP | 9-144210 | 6/1997 |
| JP | 11-350736 | 12/1999 |
| JP | 2005-9307 | 1/2005 |

* cited by examiner

*Primary Examiner*—Jeanette E. Chapman
(74) *Attorney, Agent, or Firm*—Venable LLP; Michael A. Sartori; Justine A. Gozzi

(57) ABSTRACT

There is provided a strand that can reduce the trouble in constructing an object to which compression force is applied by the strand and that can keep the construction cost down.

A strand 1 is placed in a bore hole provided in a wall or roof surface, and is gripped by a wedge in a tensioned state so as to apply a tensile force to the wall or roof surface. The strand 1 of the present invention includes a pipe-shaped member (corrugated tube 11) made of metal, and a plurality of metal wires 12 arranged on the outer periphery of the corrugated tube 11. The metal wires 12 are arranged to surround the corrugated tube 11 on the cross section of the corrugated tube 11.

6 Claims, 5 Drawing Sheets

(A)

(B)

(A)

(B)

STRAND

TECHNICAL FIELD

The present invention relates to a strand that is placed in a bore hole provided in a wall or roof surface and is gripped by a wedge in a tensioned state so as to apply a tensile force to the wall or roof surface.

BACKGROUND ART

A concrete member is not resistant to a tensile force, but is resistant to a compression force. In consideration of this characteristic of the concrete member, so-called prestressing for applying a compression force to a concrete structure beforehand is known (for example, see Patent Document 1).

FIG. 5 is a process explanatory view illustrating a typical prestressing method. Among prestressing methods, the method shown in the figure is called post tensioning. To form a prestressed concrete structure (PC structure) by prestressing, first, a cast form 20 is placed (see FIG. 5(A)), anchor plates P are placed on opposite sides of the cast form 20, and a buried pipe (bore hole) BP is placed in the cast form 20 (see FIG. 5(B)). Next, concrete is cast in the cast form 20. After the concrete sets, a strand 100 is inserted into the buried pipe BP (see FIG. 5(C)). Next, the strand 100 is tensioned at both ends of a concrete block CB, and the tensioned strand 100 is fixed at both end faces of the concrete block CB by anchors AD each including a wedge, an anchor head, and an anchor plate (see FIG. 5(D)). Then, the buried pipe BP is filled with grout, whereby a PC structure is completed (see FIG. 5(E)).

Here, to fill the above-described buried pipe BP with grout, a grout injection hole and an air discharging hole (grout discharging hole) that extend from the anchor plates to the buried pipe BP are used (see FIGS. 5(C) and 5(D)). Specifically, grout is injected into the buried pipe BP through a conduit 110, and the grout is discharged from the buried pipe BP through a conduit 120, thereby filling the buried pipe BP with the grout (see directions shown by the arrows in FIG. 5(D)).

Patent Document 1: Japanese Unexamined Patent Application Publication No. 11-350736

DISCLOSURE OF INVENTION

Problems to be Solved by the Invention

When injecting the grout, it is necessary to provide a means for coupling a grout injection device and the grout injection hole. If communication holes for allowing communication between the interior and exterior of the buried pipe are merely formed in the anchor plates and anchor heads, it is difficult to inject the grout. For this reason, in the above-described known prestressing method, communication tubes (the conduit 110 through which grout is injected and the conduit 120 through which air is discharged) for allowing communication between the interior and exterior of the buried pipe are prepared to form the grout injection hole and the grout discharging hole, and are coupled to the buried pipe. In this way, in the known prestressing method, communication tubes are separately prepared, and these communication tubes are welded to the buried pipe. Thus, since the number of components is large and construction is troublesome, the construction cost is relatively high.

Accordingly, one object of the present invention is to provide a strand that can reduce the trouble in constructing an object to which a compression force is applied by the strand and that can keep the construction cost down.

Another object of the present invention is to provide a strand that can form a strand fixing structure which allows grout to be easily injected into a bore hole provided in an object to be constructed.

Means for Solving the Problems

The present invention provides a strand that is placed in a bore hole provided in a wall or roof surface, and is gripped by a wedge in a tensioned state so as to apply a tensile force to the wall or roof surface. The strand includes a pipe-shaped member made of metal, and a plurality of metal wires arranged on the outer periphery of the pipe-shaped member. The metal wires are arranged to surround the pipe-shaped member on the cross section of the pipe-shaped member.

When inventing the strand of the present invention, the present inventors worried that, when a cylindrical member was used in a strand to be gripped by a wedge, a pipe-shaped member would be squashed by the grip force of the wedge, even if the pipe-shaped member was made of metal. However, after various studies, the present inventors found that the strand could be gripped by the wedge without squashing the pipe-shaped member by arranging metal wires in a manner such as to surround the pipe-shaped member in the strand.

According to the configuration of the present invention specified, as described above, the pipe-shaped member of the strand itself can serve as a passage that allows communication between the interior and exterior of a bore hole in which the strand is inserted. Particularly when the pipe-shaped member is used as a hole through which grout is injected, there is no need to provide a communication hole that communicates with the bore hole to inject grout, and the number of components can be reduced, compared with the case in which the known strand is used. Moreover, the trouble in coupling the bore hole and the communication hole can be omitted, which can reduce the construction cost.

The pipe-shaped member in the strand of the present invention can also be used as a hole through which grout is discharged. In this case, for example, a communication tube through which grout is injected is provided to communicate with the bore hole in which the strand is inserted, and the grout is injected into the bore hole from the communication tube. The grout injected from the injection hole is filled into the space between the bore hole and the strand, and is discharged from the bore hole through the pipe-shaped member on the inner side of the bore hole. This structure can be suitably applied to, for example, a structure for fixing a strand when an opening of the bore hole points in a downward direction inclined with respect to the horizontal direction. In this case, the grout injected from the communication tube is not discharged from the pipe-shaped member of the strand unless it is filled in the inner side of the bore hole, that is, in the entire bore hole.

The strand of the present invention is applicable to various constructions. For example, the strand is applicable to a PC structure such as a building or a bridge, a ground anchor, and a support structure of a tunnel.

The wires in the strand of the present invention may be provided parallel to the pipe-shaped member, or may be provided in the form of a stranded wire that surrounds the pipe-shaped member. Particularly when the wires are provided as a stranded wire and the pipe-shaped member is provided in the center of the stranded wire, as in the latter case, the strand can be easily bent. Hence, the strand can be easily inserted into the bore hole. Further, when the strand is gripped by the wedge, pressure acting on the outer peripheral surface of the pipe-shaped member is dispersed, and therefore, the pipe-shaped member is not easily squashed. This is because the contact area between the pipe-shaped member and each wire per unit length increases since the wire is provided obliquely along the pipe-shaped member.

The number of wires in the strand of the present invention is set such that the wires can substantially surround the entire outer periphery of the pipe-shaped member. Preferably, the wires surrounding the outer periphery of the pipe-shaped member are spaced substantially equally on the cross section. A concrete number of wires is at least five, preferably at least seven, and more preferably at least nine.

Since the strand of the present invention must be tensioned to apply a tensile force to the wall or roof surface, it needs to have a predetermined strength. Concretely, it is preferable that the breaking load of the strand be 40 to 80 tonf (about 392 to 785 kN). To achieve this breaking load, it is typical to change the material and number of wires in the strand. When the strand is formed of a general type of steel, the diameter of the strand that achieves the above-described breaking load is about 20 to 40 mm, although it depends on the materials of the pipe-shaped member and the wires. Considering that the strand is gripped by the wedge, the wires are not formed of a material, such as aramid fiber, which is not resistant to shear.

Since a construction site or the like is a space in which the scaffolding is limited and a machine for tensioning the strand is installed, a space in which the strand is handled is limited. Accordingly, it is preferable that the strand of the present invention have a predetermined flexibility. Here, flexibility of the strand in this specification means not only that the strand can be merely bent, but also that, even when the strand is bent, the pipe-shaped member of the strand is not squashed, and flow of the grout is not hindered. Specifically, it is preferable that the strand of the present invention have a flexibility such that the strand can be bent with a bending diameter which is 12 times the diameter of an envelope circle of the wires (a circle circumscribing a plurality of wires that surround the pipe-shaped member). The strand having this flexural property is quite easy to handle in an actual site.

As a typical structure for achieving the above-described flexural property, the pipe-shaped member is corrugated. To change the flexural property of the strand, for example, the ridge pitch (distance between adjacent ridges on the longitudinal section of the corrugated tube) is adjusted. When the pipe-shaped member is corrugated, not only the flexural property improves, but also the strength of the pipe-shaped member against the pressure from the outer periphery increases and the possibility that the pipe-shaped member will be squashed when the strand is gripped by the wedge is reduced.

As a structure for improving flexibility of the strand, for example, the distance between the wires arranged on the outer periphery of the pipe-shaped member is adjusted. Specifically, by setting the total distance between the adjacent wires to be 0.2 mm or more, when the strand is bent, the moving margin of the wires can be ensured between the wires arranged on the outer periphery of the pipe-shaped member, and flexibility of the strand can be improved.

Further, the adhesion between the grout and the strand can be improved by adjusting the distances between the wires. That is, in a strand in which the wires are spaced, when grout is injected into the bore hole in which the strand is placed, the surface area of the strand in contact with the grout increases, compared with a case in which no space is provided between the wires. Moreover, since the grout is filled into between the wires, physical adhesive force between the strand and the grout increases.

When the wire distance is too long, the wires that surround the outer periphery of the pipe-shaped member are apt to be arranged unequally. In a state in which the wires are unequally arranged, the force for pressing the pipe-shaped member from the outer periphery is biased. Hence, when the strand is gripped by the wedge, the pipe-shaped member provided in the center of the strand may be squashed. Further, if the wire distance is too long, particularly when the strand is bent, trouble may occur, for example, the pipe-shaped member may come out from between the wires. For this reason, it is preferable that the total wire distance be smaller than the outer diameter of the pipe-shaped member so that the pipe-shaped member will not come out from between the wires.

When there is no space between the wires, the pipe-shaped member is not easily squashed, but the flexibility of the strand and adhesion to concrete are low. In contrast, when an appropriate space is provided between the wires in the strand, the pipe-shaped member can be resistant to squash while maintaining flexibility of the strand and adhesion to concrete. That is, as the distance between the wires, there is a wire distance most suitable for flexibility of the strand, adhesion to grout, and squash prevention of the pipe-shaped member. The relationship among these is shown in Table I.

TABLE I

| | No space | Appropriate space |
|---|---|---|
| Adhesion to concrete | ○ | ◎ |
| Flexibility of strand | ○ | ◎ |
| Difficulty in squashing pipe-shaped member | ◎ | ◎ |

Evaluation criterion ◎: Very good
○: Good

Further, in the strand of the present invention, a sheath may be provided to cover the outer periphery of the strand. When the strand of the present invention includes a sheath, it can be suitably used in a ground anchor, as in the following description of a second embodiment.

Advantages

According to the strand of the present invention, in a fixing structure for the strand, a conduit that allows communication between the interior and exterior of a bore hole can be provided in the strand itself. For this reason, in contrast to the case in which the fixing structure is formed using a known strand, a communication tube that allows communication between the interior and exterior of the bore hole can be omitted. As a result, it is possible to reduce the trouble of constructing an object to which a compression force is applied by the strand, and to reduce the construction cost. Moreover, since a structure for coupling a grout injection device can be easily formed at an end of the pipe-shaped member, grout can be easily filled in the bore hole.

BRIEF DESCRIPTION OF DRAWINGS

FIG. 2(A) shows a state in which a cast form is placed, FIG. 2(B) shows a state in which anchor plates and a buried pipe are arranged, FIG. 2(C) shows a state in which the strand of the present invention is arranged, FIG.

2(D) shows an injection state of grout, and FIG. 2(E) shows a state in which prestressing is completed.

FIG. 5(A) shows a state in which a cast form is placed, FIG. 5(B) shows a state in which anchor plates and a buried pipe are arranged, FIG. 5(C) shows a state in which a known strand is arranged, FIG. 5(D) shows an injection state of grout, and FIG. 5(E) shows a state in which prestressing is completed.

Figure 1:
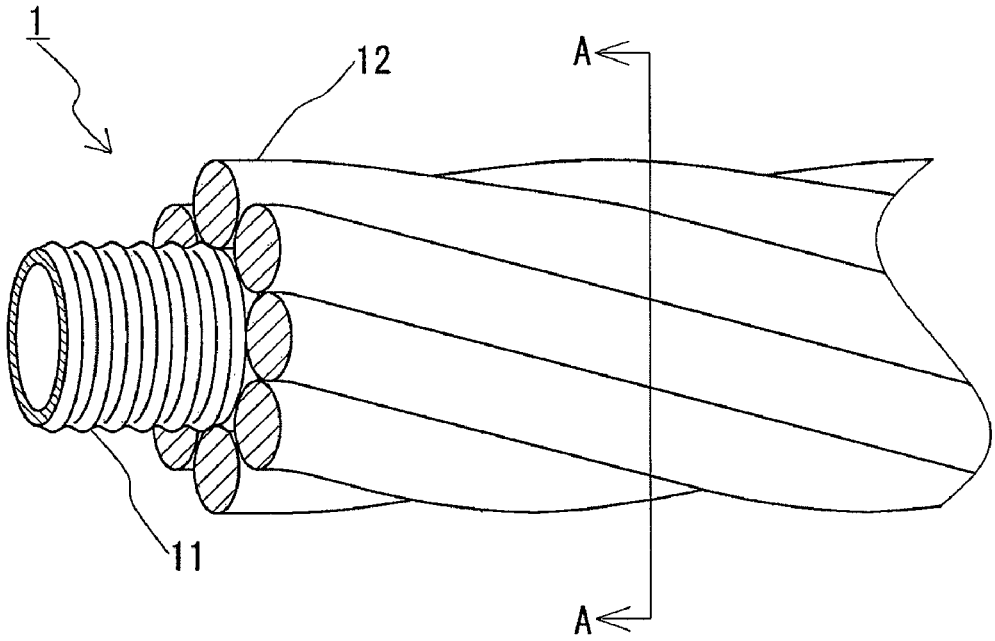
FIG. 1(A) is a partial perspective sectional view of a strand according to the present invention.
FIG. 1(B) is a cross-sectional view, taken along line A-A in FIG. 1(A).
Figure 1:
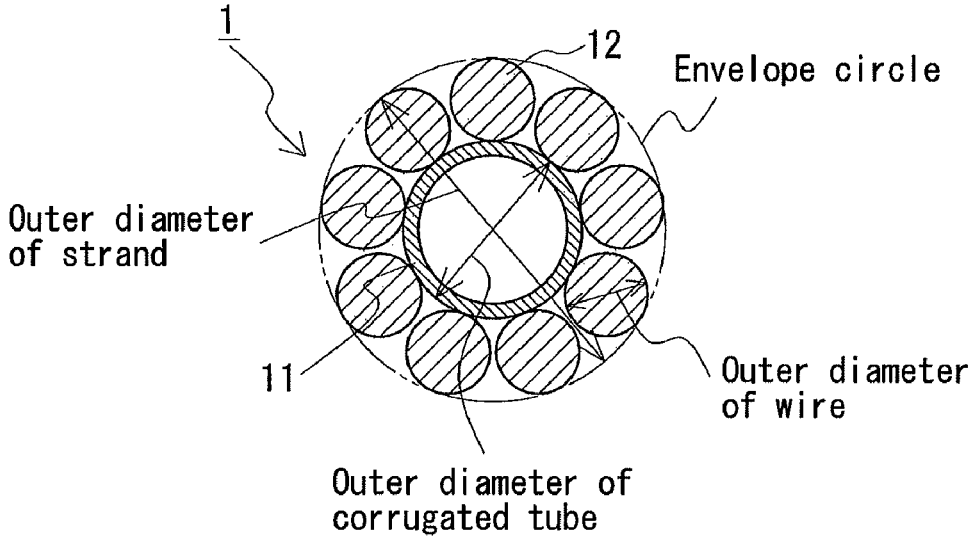

| Reference Numerals | |
|---|---|
| 1, 2 | strand |
| 11 | corrugated tube |
| 12 | wire |
| 13 | sheath |
| 14 | water seal |
| 20 | cast form |
| 100 | strand |
| 110 | grout injection conduit |
| 120 | air discharging conduit |
| CB | concrete block |
| BP | buried pipe |
| G | ground |
| C | concrete |
| H | borehole |
| AD | anchor |
| AD1 | dead anchor |
| AD2 | anchor head |
| P, P1, P2, P3 | anchor plate |
| D1, D2, D3 | anchor head |
| Dh1, Dh2, Dh3, TH | through-hole |
| W1, W2, W3 | wedge |
| S1, S2 | cap |

BEST MODES FOR CARRYING OUT THE INVENTION

Embodiments of the present invention will be described below with reference to the drawings.

First Embodiment

Figure 2:
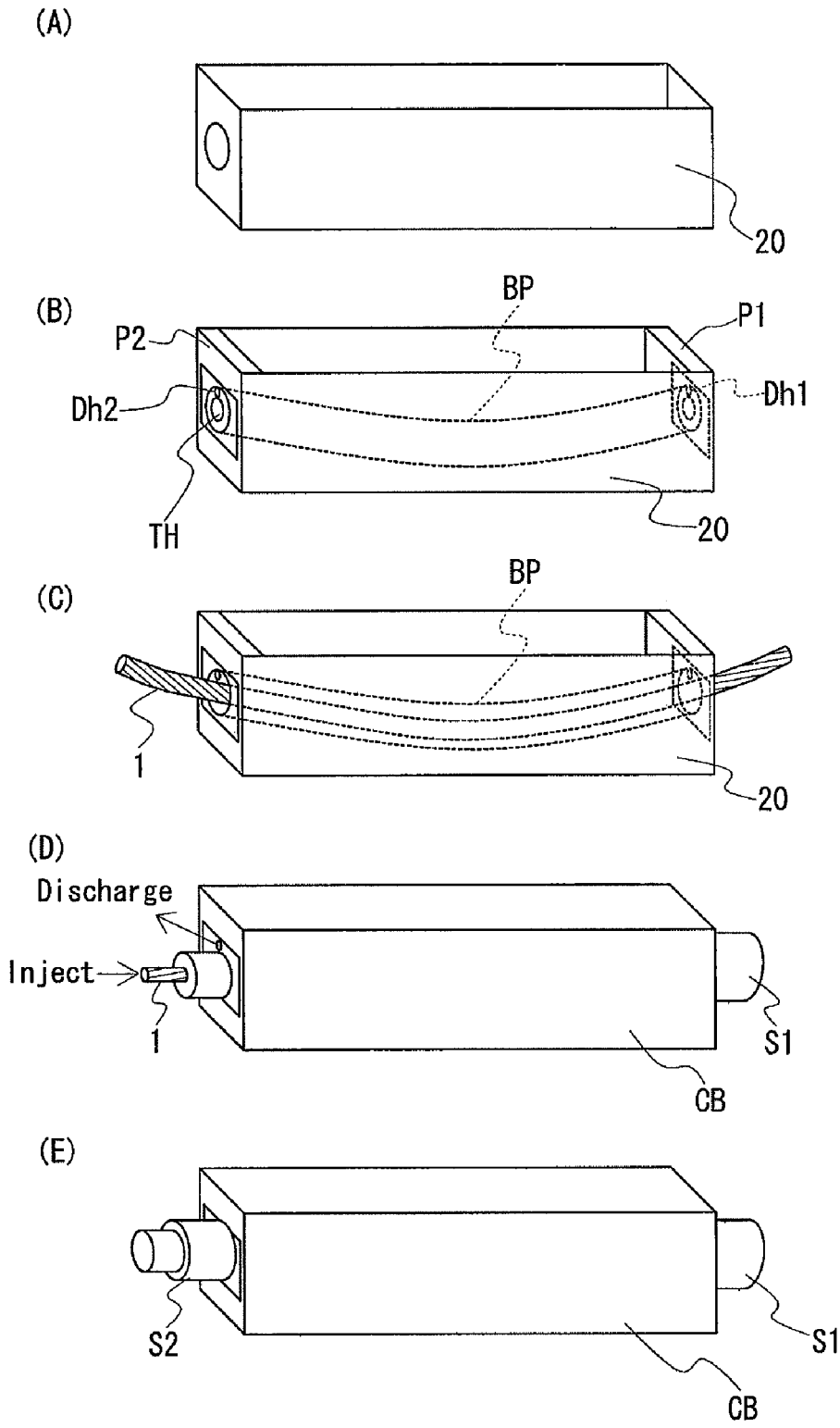
FIGS. 2(A), 2(B), 2(C), 2(D) and 2(E) are process explanatory views illustrating a procedure of prestressing described in a first embodiment.

An embodiment in which a PC structure is formed using a strand of the present invention will be described with reference to FIGS. 1 and 2.

[Strand]

FIG. 1(A) is a partial perspective sectional view of a strand according to this embodiment, and FIG. 1(B) is a cross-sectional view, taken along line A-A in FIG. 1(A). As shown in FIG. 1(B), in a strand 1, wires 12 are arranged to surround a corrugated tube (pipe-shaped member) 11 on the cross section. As shown in the figure, the strand 1 of the embodiment includes the corrugated tube 11 and nine wires 12 stranded on the outer periphery of the corrugated tube 11. Of course, the number of wires is not limited to nine. For example, the strand may be formed by stranding five or seven wires on the outer periphery of the corrugated tube.

The corrugated tube 11 is formed of an unpolished welding steel plated with Cr. The corrugated tube 11 formed of this material is excellent in flexibility. Moreover, when bent, the corrugated tube 11 is not squashed to decrease the strength of the strand 1, and the function as a passage for passing grout therethrough does not decrease, as will be described below. Further, the structure of the corrugated tube 11, that is, the undulated structure is resistant to the pressure from the outer periphery of the tube 11, and is not easily squashed even when the strand is gripped by the wedge.

The wires 12 are formed of a steel: SWRS82B (JIS G 3502). Of course, the material of the wires 12 is not limited to the above-described steel. For example, a material having a high content of Si (Si content is 0.32% or more by mass) or a high-strength steel material described in a modification that will be described below can be suitably used. Further, the wires 12 are produced by wire drawing. The wires are excellent in strength, and have an appropriate flexibility.

The strand 1 of the embodiment using the corrugated tube 11 and the wires 12 described above was produced as follows.

First, the wires 12 were wound around the corrugated tube 11. Specifically, the wires 12 and the corrugated tube 11 were set in a stranding machine and were stranded together.

Next, a tension of 10 to 40% of the breaking load of the strand 1 (breaking load estimated from the material) was applied to the formed strand 1, and blueing was performed for about 30 seconds at about 400° C. Blueing can improve toughness of the strand 1 and improve the flexural property. Preferably, blueing is performed at 300 to 450° C. and for 10 to 90 seconds.

Table II shows the dimensions and breaking loads of strands produced, as described above. In Table II, the diameter of the strand refers to the diameter of an envelope circle of the wires, the outer diameter of the corrugated tube refers to the outer diameter of ridges of the undulated shape, and the inner diameter of the corrugated tube refers to the inner diameter of grooves of the undulated shape.

TABLE II

| Strand | | | Wire | Corrugated tube | | |
|---|---|---|---|---|---|---|
| Length(m) | Outer diameter(mm) | Breaking load(kN) | Outer diameter(mm) | Outer diameter(mm) | Inner diameter(mm) | Steel plate thickness(mm) |
| 8 | 24.4 | 501 | 6.15 | 13.00 | 10.2 | 1.0 |
| 8 | 26.3 | 591 | 6.62* | 14.60 | 11.4 | 1.0 |

*Material having high content of Si

Although not shown in Table II, the distance (ridge pitch) between ridges of the corrugated tube of each strand on the longitudinal section is two ridge/cm. Referring to the total wire distance of the produced strand, the total wire distance was 4.6 mm in the strand having a diameter of 24.4 mm and 6.0 mm in the strand having a diameter of 26.3 mm. Even when the produced strands were bent with a bending diameter that is 12 times the outer diameter of the strand (diameter of the envelope circle of the wires), the corrugated tubes and the wires in the strands were not damaged at all.

[Method for Forming PC Structure]

A PC structure is formed using the above-described strand 1. FIG. 2 is a process explanatory view showing a method for forming a PC structure by prestressing (post tensioning). To form a PC structure, first, a cast form 20 is placed (see FIG. 2(A)). Next, anchor plates P1 and P2 are fitted beforehand in portions of the cast form 20 where the strand 1 is to be placed, and a buried pipe (bore hole) BP is placed in the cast form 20 (see FIG. 2(B)). The anchor plate P2 is provided with a through-hole TH through which the strand is inserted, and a small through-hole Dh2 (having a diameter of about 12 mm) through which air is removed from the buried pipe BP. The plate P1 is provided with a through-hole Dh1 serving as a flow passage for grout, as will be described below. Unlike the known anchor plates, the anchor plates P1 and P2 need not have a communication tube that communicates with the buried pipe.

Next, concrete is cast in the cast form 20. After the concrete sets, the cast form 20 is removed, and the strand 1 is inserted in the buried pipe BP and is tensioned (see FIG. 2(C)). When tensioning the strand 1, first, the strand 1 is fixed at one end of a concrete block CB (on the right side of the paper plane) by a dead anchor. Next, the strand 1 is tensioned at the other end (on the left side of the paper plane), and the strand 1 is fixed by a anchor head. By being tensioned, the strand 1 is extended, and a force (tensile force) for returning the strand 1 to an initial state is generated. When the strand 1 is fixed, the tensile force of the strand 1 is transmitted to the concrete block CB, whereby a PC structure is formed.

After the strand 1 is tensioned and fixed, the outer periphery of the dead anchor is capped with a cap S1 to be sealed, as shown in FIG. 2(D). Then, grout is filled from a pipe-shaped member of the strand 1 so that the buried pipe BP is filled with the grout.

Figure 3:
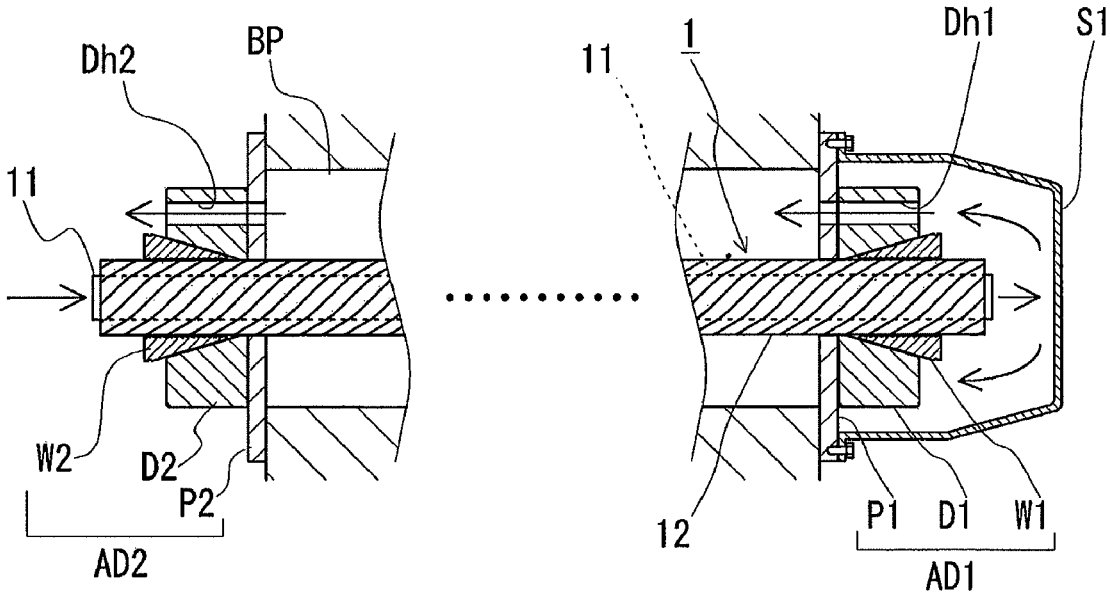
FIG. 3 is a partial cross-sectional view of a PC structure, illustrating the injection state of grout shown in FIG. 2(D) in detail.

FIG. 3 is a partial cross-sectional view of the PC structure, showing the step of filling the buried pipe with grout in more detail. The strand 1 is fixed by a dead anchor AD1 including a wedge W1, an anchor head D1, and an anchor plate P1, and a anchor head AD2 including a wedge W2, an anchor head D2, and an anchor plate P2. The outer periphery of the formed dead anchor AD1 is sealed by the cap S1. In this structure, when grout is injected from an end of the corrugated tube 11 at the anchor head AD2, the injected grout is released into the cap S1 from an end of the corrugated tube 11 at the dead anchor AD1. The grout released into the cap S1 flows through the through-hole Dh1, and flows into the buried pipe BP. Then, the grout is discharged from the buried pipe BP through the through-hole Dh2 of the anchor head AD2.

When the grout, which is filled in the buried pipe BP, as described above, sets, the outer periphery of the anchor head is also capped with a cap S2, as shown in FIG. 2(E), and a rust preventive material is filled within the cap S2, whereby a PC structure is completed.

With the configuration of this embodiment, it is unnecessary to provide a connecting pipe that communicates with the buried pipe and is used to inject and discharge the grout. For this reason, the number of components and labor of construction can be reduced and construction cost can be reduced, compared with the PC structure using the known strand.

In the strand of the present invention, grout is filled in the pipe-shaped member and is set at the completion of construction, and the pipe-shaped member does not remain hollow. For this reason, the strand of the present invention has a sufficient strength as a tensioned member, and does not have any problem in rust prevention. Further, a space can be left in the pipe by controlling the amount of grout to be injected.

[Modification]

In this modification, a steel material having a higher strength is used as the material of the wires in the strand described as the first embodiment.

To obtain a strand of this modification, drawn wires (samples 1 to 5) were obtained by cold-drawing DLP (Direct In-Line Patenting) wires (from Nippon Steel Corporation) having a wire diameter of 14 mm to a wire diameter of 6.93 mm. The DLP wires as the materials of the drawn wires were composed of C: 0.98 to 1.02% by mass, Si: 0.85 to 0.95% by mass, Mn: 0.35 to 0.45% by mass, P: 0.018% or less by mass, S: 0.010% or less by mass, Cu: 0.15% or less by mass, Cr: 0.20 to 0.25% by mass, and the rest: Fe and unavoidable impurities. The following Table III shows mechanical characteristics of the obtained drawn wires.

TABLE III

| Sample No. | Wire diameter(mm) | Breaking load (kN) | Elongation (%) | Reduction (%) |
|---|---|---|---|---|
| 1 | 6.93 | 77.9 | 7 | 46.8 |
| 2 | 6.93 | 77.8 | 7 | 47.1 |
| 3 | 6.93 | 77.9 | 8 | 46.7 |
| 4 | 6.92 | 77.6 | 7 | 46.7 |
| 5 | 6.93 | 77.8 | 7 | 46.9 |

Each of the drawn wires shown in Table III was cut to a predetermined length to form wires, and a strand was produced by stranding nine wires, which were obtained by cutting one drawn wire, on the outer periphery of a corrugated tube. The used corrugated tube was the same as that used in the first embodiment, and the wires were stranded with the corrugated tube by a method similar to that adopted in the first embodiment. The strand in which the wires were stranded was subjected to blueing under conditions similar to those adopted in the first embodiment. Table IV shows the dimensions, breaking loads, and elongations of the produced strands. Since the wires are arranged on the outer periphery of the corrugated tube, the envelope circle of the strand is slightly elliptical. Hence, the long axis of the ellipse is given as the largest wire diameter, and the short axis is given as the shortest wire diameter.

TABLE IV

| | Wire diameter (mm) | | Breaking load | | |
|---|---|---|---|---|---|
| Sample No | Shortest | Largest | kN | ton | Elongation(%) |
| 1 | 27.35 | 27.78 | 697 | 71.12 | 6.5 |
| 2 | 27.34 | 27.76 | 698 | 71.22 | 7.1 |
| 3 | 27.35 | 27.76 | 696 | 71.02 | 7.2 |
| 4 | 27.38 | 27.77 | 697 | 71.12 | 7.0 |
| 5 | 27.36 | 27.77 | 697 | 71.12 | 6.8 |

Although not shown in Table IV, the total wire distances of the produced strands were about 2.5 mm. Further, even when the strands were bent with a bending radius that is 12 times the outer diameter of the strands, the corrugated tubes and the wires in the strands were not damaged at all.

As shown in Table IV, the strand formed by stranding the wires made of a high-strength steel material on the outer periphery of the corrugated tube had a breaking load of about 700 kN and an elongation of about 7%. That is, it was revealed that the mechanical characteristics of the wire are reflected as the mechanical characteristics of the strand. Therefore, according to the strand of this modification, it is possible to form a PC structure having a larger bearing force.

Second Embodiment

In this embodiment, a description will be given of a ground anchor formed using a strand, in which a sheath is further provided on the outer periphery of the strand of the present invention, with reference to FIG. 4. Since the strand of this embodiment has structures similar to those of the strand of the first embodiment except that the sheath is provided on the periphery thereof, the similar structures are denoted by the same reference numerals as those in the first embodiment, and descriptions thereof are omitted.

A tube formed of plastic, such as polyethylene, was used as a sheath 13 provided on the outer periphery of a strand 2. Of course, the sheath 13 may be formed of metal. Further, the sheath 13 may be corrugated to have flexibility such as not to hinder bending of a corrugated tube 11 and wires 12 in the sheath 13.

Figure 4:
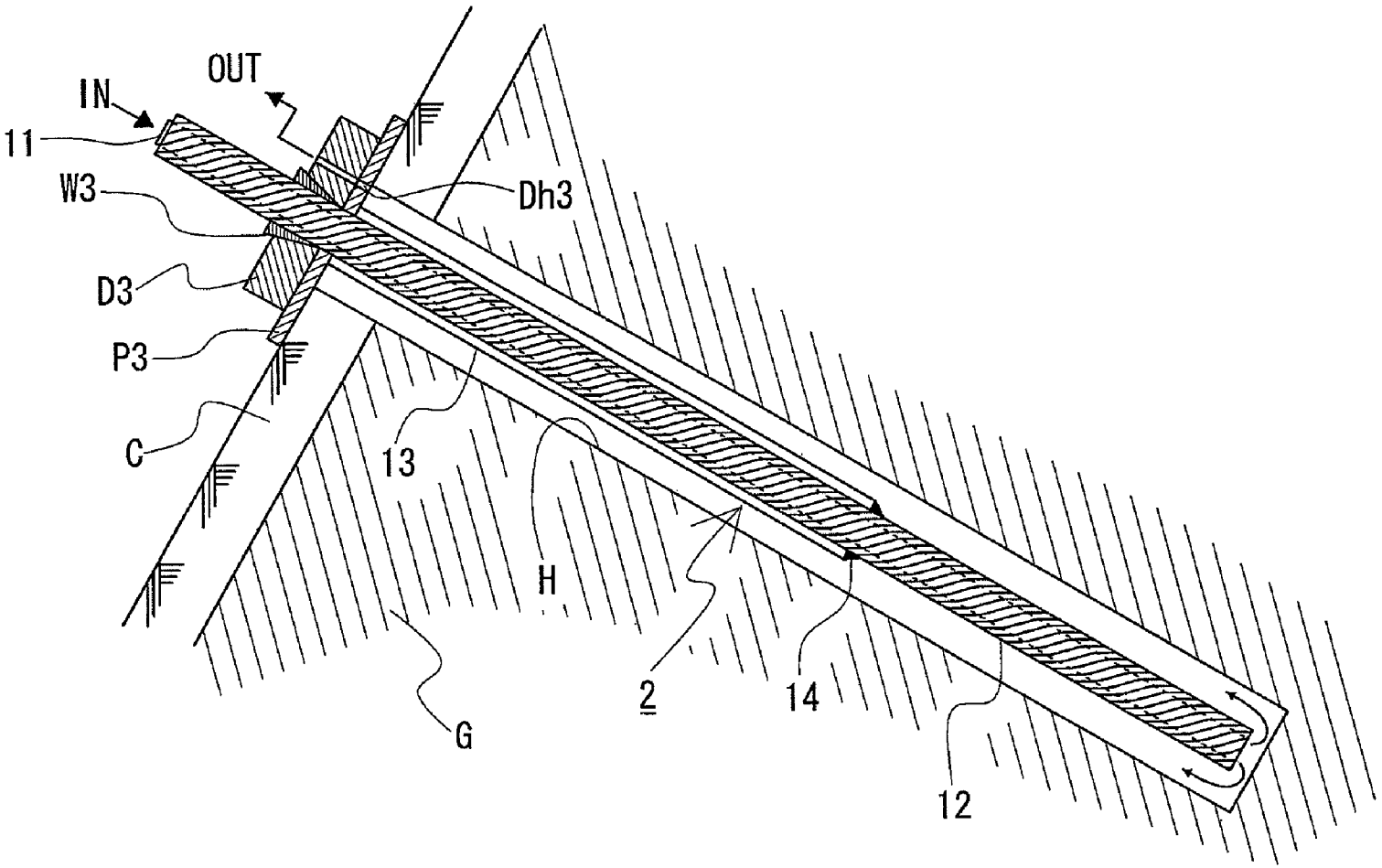
FIG. 4 is a schematic structural view of a ground anchor according to a second embodiment, which uses the strand of the present invention having a sheath on the periphery.
Figure 5:
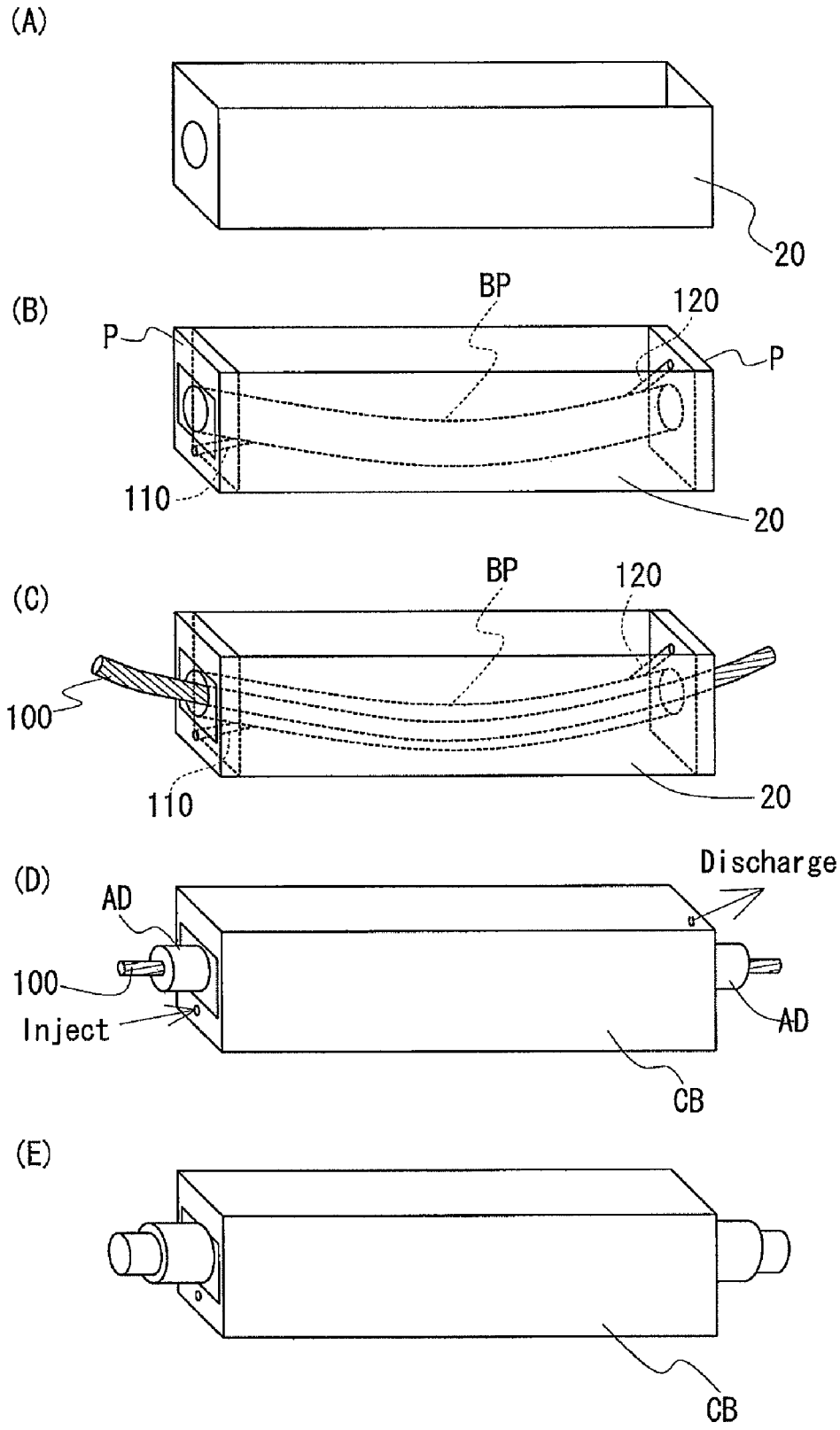
FIGS. 5(A), 5(B), 5(C), 5(D) and 5(E) are process explanatory views illustrating a known procedure of prestressing.

Referring to FIG. 4, a detailed description will be given below of a method for placing the ground anchor (strand 2) in a ground G having a borehole (bore hole) H and applying a tensile force to concrete C (wall or roof surface) that covers the ground G.

To bring the strand 2 into the arrangement state shown in FIG. 4, first, the sheath 13 is stripped off by a predetermined length at one end of the strand 2 so that the wires 12 are exposed in that stripped portion. At an end of the stripped sheath 13, a water seal 14 is formed to seal the space between the sheath 13 and the wires 12.

Next, in a state in which the strand 2 extends through strand insertion holes of an anchor head D3 and an anchor plate P3, the anchor head D3 and the anchor plate P3 are temporarily fixed to the ground G to seal the borehole H. The anchor head D3 and the anchor plate P3 are provided with through-holes Dh3 through which grout is discharged from the borehole H. Instead of forming the through-holes in the anchor head D3 and the anchor plate P3, a communication tube that extends from the ground G to the borehole H may be provided separately.

When placement of the strand 2, the anchor head D3, and the anchor plate P3 is completed, grout is injected into the borehole H from the corrugated tube 11 of the strand 2. The injected grout is discharged from an open end of the corrugated tube 11 at the bottom (on the right side of the paper plane) of the borehole H into the borehole H, and fills the borehole H. Then, the grout filled in the borehole H is discharged from the through-holes Dh3 of the anchor plate P3 and the head D3, whereby filling the borehole H with grout is finished. In this case, considering that the strand is tensioned after the grout sets, air is sent from an upper end of the corrugated tube 11 so that the corrugated tube 11 becomes hollow in a portion from the upper end of the corrugated tube 11 to the adjacency of the boundary with the water seal 14 for sealing the opening of the sheath 13.

The grout sets when a predetermined time has elapsed since the grout was filled in the borehole H. Here, in the strand 2 of this embodiment, each wire 12 is divided, at the boundary between the sheath 13 and the water seal 14 for sealing the opening of the sheath 13, into an exposed portion and a portion covered with the sheath 13. For this reason, when the grout sets, only the exposed portion of the wire 12 in the strand 2 is fixed to the borehole H.

Finally, the strand 2 protruding from the anchor head D3 is tensioned, and is fixed to the anchor head D3 by a wedge W3.

As described above, the strand of the present invention can also be suitably used as a ground anchor for prestressing the ground.

The present invention is not limited to the above-described embodiments, and can be appropriately modified without departing from the scope of the present invention. For example, a construction to which the strand of the present invention is applied may be a tunnel or an architectural structure such as a building.

INDUSTRIAL APPLICABILITY

The strand of the present invention can be suitably used to prestress a concrete structure.

The invention claimed is:

1. A strand placed in a bore hole provided in a wall or roof surface and gripped by a wedge in a tensioned state so as to apply a tensile force to the wall or roof surface, the strand comprising:

a pipe-shaped member made of metal; and a plurality of metal wires arranged on the outer periphery of the pipe-shaped member, wherein the metal wires are arranged to surround the pipe-shaped member on the cross section of the pipe-shaped member, wherein the total distance between the wires is 0.2 mm or more, and is smaller than an outer diameter of the pipe-shaped member, and wherein the strand has flexibility such that the pipe-shaped member is not squashed even when the strand is bent with a bending diameter that is 12 times a diameter of an envelope circle of the strand.

2. The strand according to claim 1, wherein the metal wires are stranded around the pipe-shaped member.

3. The strand according to claim 1, wherein the strand has a breaking load of 40 to 80 tonf (about 392 to 785 kN).

4. The strand according to claim 1, wherein the pipe-shaped member is a corrugated tube.

5. The strand according to claim 1, wherein a sheath is provided to cover an outer periphery of the strand.

6. A strand insertable in a wall or roof surface defining a bore hole and gripped by a wedge in a tensioned state so as to apply a tensile force to the wall or roof surface, the strand comprising:

a pipe-shaped member having an outer diameter, the member comprising metal; and a plurality of metal wires arranged on the outer periphery of the pipe-shaped member and arranged to surround the pipe-shaped member on a cross section of the pipe-shaped member, each respective wire distanced apart from an adjacent wire, wherein a sum of the distances between each respective wire is at least 0.2 mm and the sum is less than the outer diameter of the pipe-shaped member, and wherein the strand has flexibility such that the pipe-shaped member is not squashed even when the strand is bent with a bending diameter that is 12 times a diameter of an envelope circle of the strand.

* * * * *